US005642694A

United States Patent [19]

Dura et al.

[11] Patent Number: 5,642,694

[45] Date of Patent: Jul. 1, 1997

[54] INTEGRAL FORMED OIL COLUMN EXTENDER FOR HYDRAULIC LASH ADJUSTER

[75] Inventors: Lowell Eugene Dura, Belmont; William Paul Vukovich, Kentwood; Robert L. Kauffman, Jr., Lake Odessa, all of Mich.

[73] Assignee: General Motors Corporation, Detroit, Mich.

[21] Appl. No.: 658,901

[22] Filed: May 24, 1996

[51] Int. Cl.[6] ..... F01L 1/24

[52] U.S. Cl. ..... 123/90.43; 123/90.46; 123/90.55

[58] Field of Search ..... 123/90.43, 90.46, 123/90.48, 90.52, 90.55, 90.59

[56] References Cited

U.S. PATENT DOCUMENTS

| | | | |
|---|---|---|---|
| 2,688,319 | 9/1954 | Humphreys | 123/90.55 |
| 4,840,153 | 6/1989 | Aida et al. | 123/90.43 |
| 4,887,566 | 12/1989 | Shida | 123/90.55 |
| 4,917,059 | 4/1990 | Umeda | 123/90.43 |
| 4,920,935 | 5/1990 | Shida | 123/90.55 |

*Primary Examiner*—Weilun Lo
*Attorney, Agent, or Firm*—Karl F. Barr, Jr.

[57] ABSTRACT

A hydraulic lash adjuster for an internal combustion engine, and a method of its construction is disclosed. The lash adjuster has a cylindrical follower body in which a tubular plunger is slidingly disposed. The plunger cooperates with the follower body to define a high pressure chamber therebetween which is supplied with fluid through a valved port. A low pressure chamber which operates to supply fluid to the high pressure chamber through the valved opening, is defined by an axial passage through the plunger. Fluid flows into and out of the low pressure chamber through a port in the wall of the plunger. Intermediate of the port and the valved opening is a radially inwardly extending annular shelf which is integral formed with the axial passage of the plunger using a mechanical shaving step to plow a portion of the plunger material from the wall of the axially extending passage. The annular shelf operates as a baffle to prevent loss of fluid from the low pressure chamber when the hydraulic lash adjuster is installed at an angle from vertical.

3 Claims, 2 Drawing Sheets

10
12
16
18,40
20
34
36
46
48
50
64
66
68
70
72
76
78
80
81

INTEGRAL FORMED OIL COLUMN EXTENDER FOR HYDRAULIC LASH ADJUSTER

TECHNICAL FIELD

The invention relates to hydraulic lash adjusters for use in internal combustion engines.

BACKGROUND

When a hydraulic lash adjuster is used, for example, in an overhead cam engine to serve as the fulcrum for a rocker arm in the poppet valve operating train of the engine, the lifters are typically dependent on an internal oil reservoir for proper function on initial engine start-up. During inoperative periods, pressure chamber oil will typically escape therefrom between the sliding surfaces of the lash adjuster plunger and follower body. Oil stored within the follower body is used by the lash adjuster to refill the pressure chamber during the time interval that the engine lubricating system requires to refill the lifter. The performance of these lifters is adversely affected by angles of installation which effectively reduce the height of the stored oil column in the follower body.

The problem created by large installation angles has been addressed previously by installation of a separate baffle member into the lash adjuster body. The baffle member is configured to increase the height of the stored oil column. The addition of the baffle increases the cost of the lifter substantially as processing is impacted by the additional operation required to install the baffle and by the cost of the component which is typically a precision stamped piece.

SUMMARY OF THE INVENTION

The present invention relates to a hydraulic lash adjuster for use in an internal combustion engine where large angles of installation are required. The adjuster includes a closed-end follower body having a tubular plunger slideable therein. A check valve assembly is disposed between the plunger and the follower body to define a high pressure chamber below the valve and a low pressure oil chamber above the valve and within the plunger. The plunger is constructed by extruding an axially extending tubular passage which extends substantially the length of the plunger. An integral baffle feature is defined by an annular shelf disposed intermediate of the plunger ends. The shelf extends radially inwardly from the walls of the plunger and includes a central opening. The baffle is formed by shaving material from the inner wall of the plunger following initial extrusion of the cylindrical passage. The integral baffle operates to increase the volume of retained-oil, stored in the low pressure oil chamber of the plunger, when the plunger is angularly installed within the engine by relocating the exit opening through which the oil must pass to exit the plunger. The integral design of the baffle simplifies construction of the hydraulic lash adjuster by eliminating a separate baffle component and its installation.

The details, as well as other features and advantages of the preferred embodiment of the invention are set forth in the following detailed description and drawings.

DESCRIPTION OF THE PREFERRED EMBODIMENT

Figure 1:
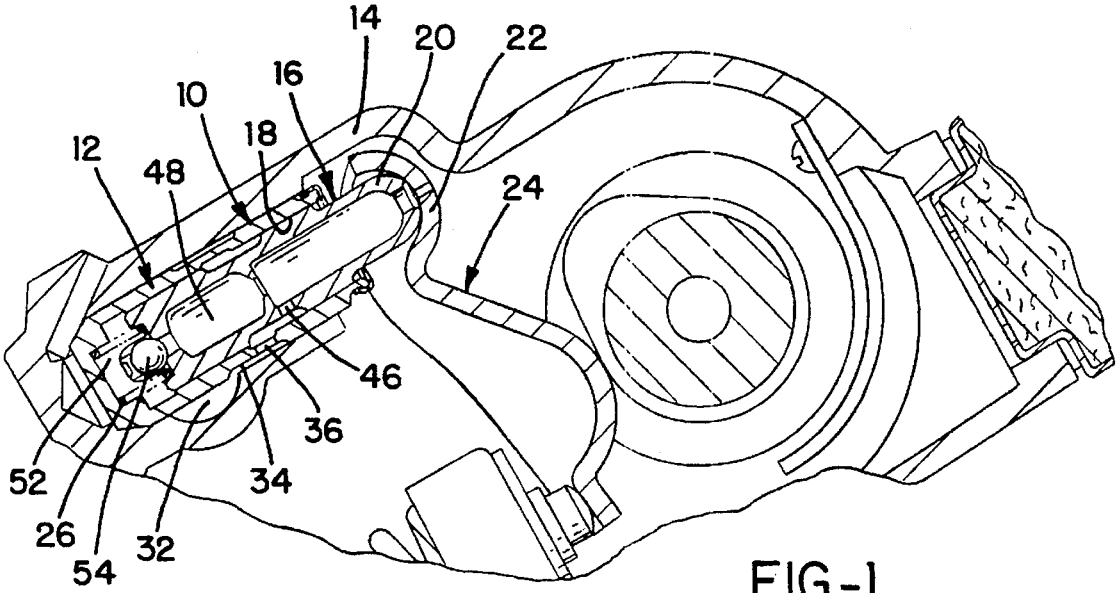
FIG. 1 is a partial, sectional view of an internal combustion engine embodying features of the present invention.
Figure 2:
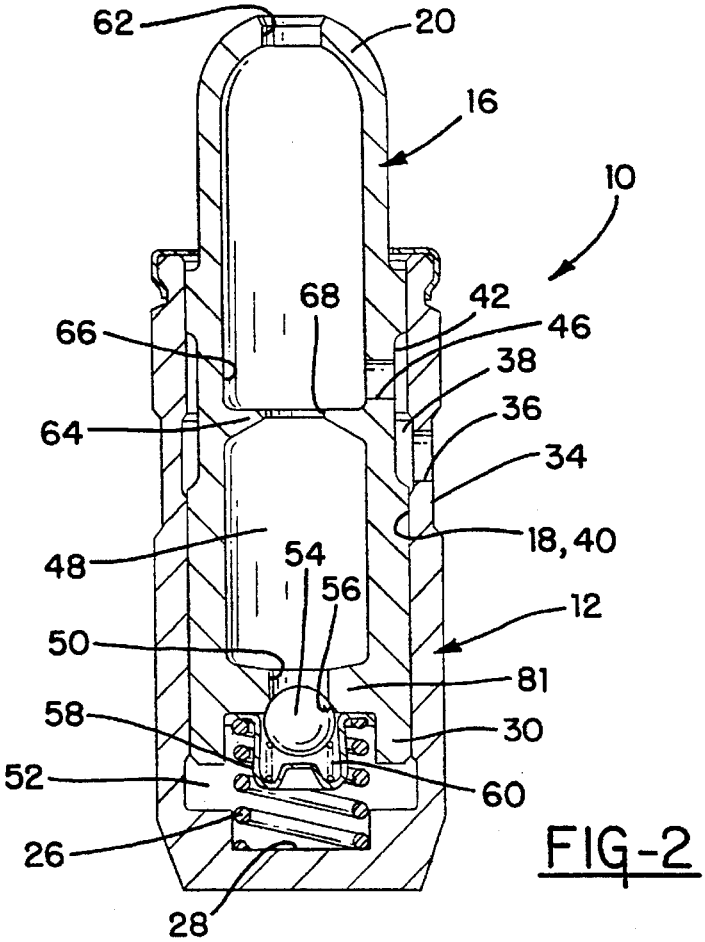
FIG. 2 is an elevational view, in section, of a hydraulic element assembly embodying features of the present invention.

In FIGS. 1 and 2 there is shown a valve lash adjuster, designated generally as 10, which includes a generally cup-shaped cylindrical body 12 configured to be received in an engine cylinder head 14, or other suitable installation location. The cup-shaped cylindrical body 12 forms a dash pot for a tubular plunger 16 configured for sliding disposition within the bore 18 of the body 12. In the embodiment shown, the tubular plunger 16 includes a semispherically shaped, upper thrust end 20 which extends out from the body 12 for engagement with a corresponding, concave portion 22 of a rocker arm 24 in cylinder head 14.

A plunger return spring 26 is interposed between the bottom 28 of the cup-shaped body 12 and the lower end 30 of the plunger 16 and acts to bias the plunger 16 such that contact is maintained with the spherically concave portion 22 of the rocket arm 24. Fluid for the dash pot of the lash adjuster 10 is in the form of oil supplied from the engine lubricating system to a gallery 32. An external annular groove 34 in the body 12 communicates through port 36 to deliver oil to annular space 38 defined by the inner wall 40 of the body 12 and an annular groove 42 in the outer surface of the tubular plunger 16. A second port 46 extends through the plunger wall and provides a means for fluid communication between annular space 38 and the interior, low pressure reservoir 48 of the plunger 16.

The lower end of the plunger 16 is provided with an outlet port 50 through which oil, stored within the low pressure reservoir 48, may flow into the high pressure chamber 52 defined between the lower end 30 of the plunger 16 and the bottom, closed end 28 of the cup-shaped body 12. Flow through the outlet port 50 is controlled by a one-way valve in the form of a ball 54 which closes against a seat 56 encircling the lower end of the outlet port 50. A suitable valve cage 58 and valve return spring 60 limits open travel of the valve ball 54 to the amount necessary to accomplish replenishment of the pressure chamber 52 with oil which normally escapes therefrom between the sliding surfaces of the tubular plunger 16 and the cup-shaped follower body 12 as "leak-down". As shown, the valve cage 58 is held against the plunger 16 by the plunger spring 26 or, alternatively, the valve cage could be fixed to the plunger 16 using an interference fit.

The interior, low-pressure chamber 48 of the plunger 16 extends substantially the length of the plunger, from adjacent the outlet port 50 to the semi-spherical thrust end 20. An opening 62 extends through the thrust end 20 of the plunger 16 to enable oil within the reservoir 48 to lubricate the end 22 of the rocker arm 24. An integral baffle 64 is disposed within the low-pressure chamber 48 intermediate the ends of the chamber. The baffle 64 is configured as an annular shelf which extends radially inwardly from the inner wall 66 of the low-pressure chamber 48 to define a central opening 68 for the passage of oil from the oil supply port 46 to the outlet port 50.

Figures 3A, 3B, 3C, 4A, 4B, 4C, 4D, 4E, 4F:
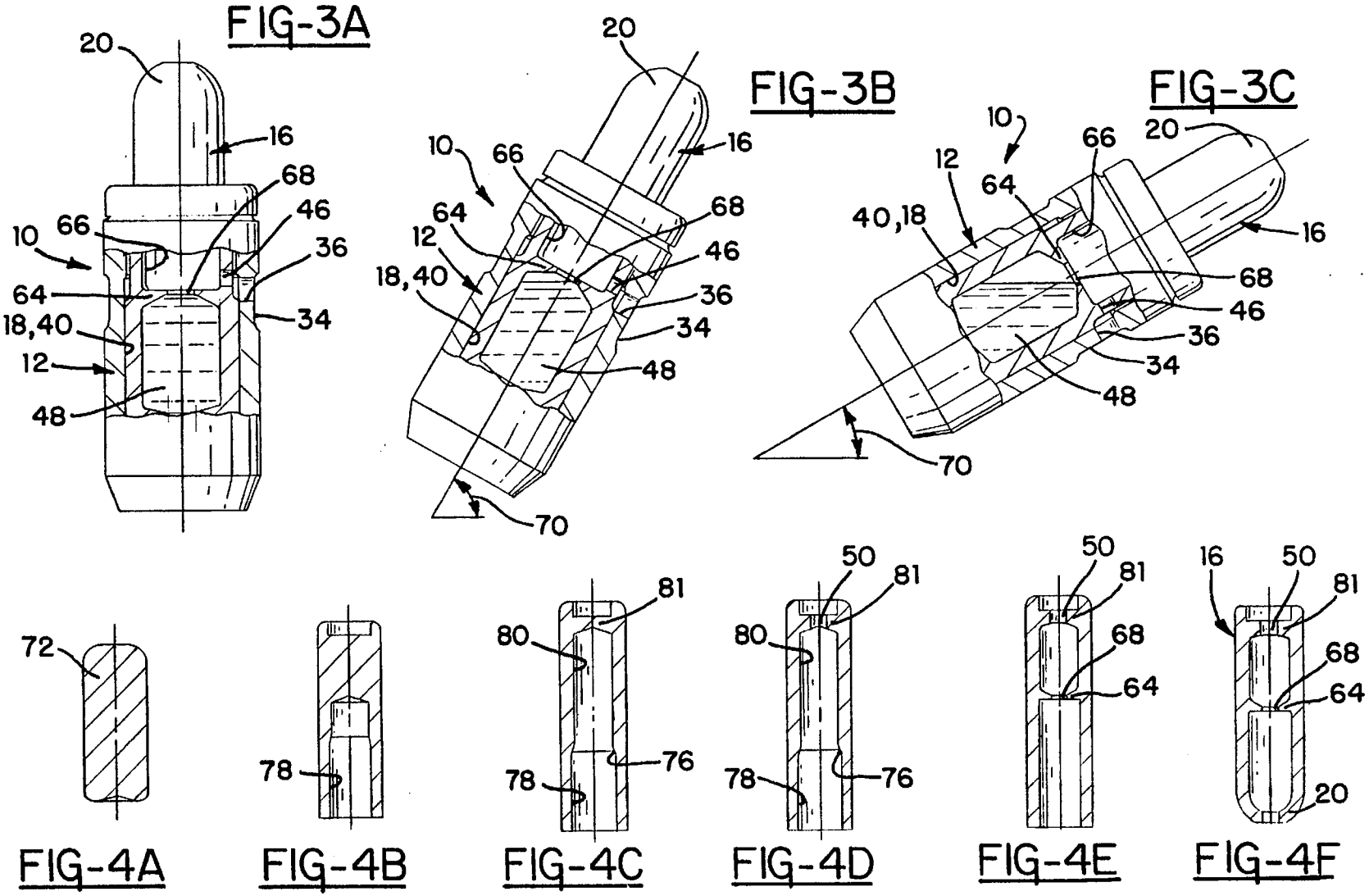
FIGS. 3A, 3B, and 3C illustrate the hydraulic element assembly of FIG. 2 at successively severe angles of installation.
FIGS. 4A–4F illustrate steps in the forming of a portion of the hydraulic element assembly of FIG. 2.

As illustrated in the sequential illustration of FIGS. 3A–3C, the integral baffle 64 functions to increase the quantity of retained oil in the low pressure chamber 48 of the plunger 16 through the damming action of the radially inwardly extending shelf. The shelf establishes an increase in the volume of retained oil which must fill the low pressure chamber prior to spilling through the opening 68 in the baffle 64 and out of the plunger 16 through the inlet port 46. The volume of retained oil is a function of lash adjuster installation angle 70.

Construction of the plunger 16 is illustrated in the sequential illustration of FIGS. 4A–4F. The process begins with a slug 72, FIG. 4A, which is inserted into a die for subsequent extrusion, FIGS. 4B and 4C, of the axial passage 78 which will eventually form the low-pressure chamber 48 of the plunger 16. The extrusion is preferably a multiple step process which results in a stepped internal plunger diameter with a ledge 76 separating the larger and smaller diameter portions 78 and 80, respectively. A first extrude results in a partially drawn piece, FIG. 4B, having a reduced diameter lead-in 78 for the second extrude, FIG. 4C, which matches the smaller diameter of the lead-in 78 to establish the stepped inner diameter 80. Subsequent to complete extrusion of the stepped diameter, axial passage 78, FIG. 4C, the lower web 81 is pierced to form the outlet passage 50 through which oil may flow to the high pressure chamber 52 of the assembled lash adjuster 10. The integral baffle 64 is formed utilizing excess wall material from the smaller diameter portion 80 of the plunger wall. A shave punch, or other suitable tooling, is inserted into the plunger 16 and moved axially inwardly to engage and "plow back" the ledge 76 to form the annular shelf of the integral baffle 64, FIG. 4E. The opening 68 defined by the radially inwardly extending baffle 64 is formed by a properly sized nose on the punch. Following formation of the integral baffle 64 within the axial passage 78 of the plunger 16, the thrust end 20 of the plunger 16 is coined and formed so as to properly mate with the concave end 22 of the rocker arm 24. Forming the baffle 64 integrally with the plunger body 16 during the formation of the body, requires minimal additional forming steps and eliminates handling, installation and cost issues associated with a separately installed baffle.

While the present invention has been disclosed with respect to a particular embodiment of hydraulic lash adjuster, it is contemplated that the integral baffle has application in many configurations of lash adjuster having a similarly constructed plunger in which the quantity of oil retained in the low-pressure chamber for supply to the high-pressure chamber is desired to be increased as a result of extreme installation angles of the lash adjuster.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A hydraulic lash adjuster comprising a cylindrical follower body, a tubular plunger slidingly received within said follower body, said plunger and said cylindrical follower body cooperating to define a high pressure chamber therebetween, said plunger including an axially extending passage having an inner wall defining an interior reservoir for supplying fluid to said high pressure chamber through a valved opening disposed therebetween, said axially extending passage having a port through which fluid flows into and out of said interior reservoir, and a radially inwardly extending annular shelf formed from and one-piece with said inner wall of said axially extending passage, said annular shelf disposed between said valved opening and said port, said annular shelf operable to define a baffle to limit fluid flow out of said port when said lash adjuster is operated at an angle from vertical.

2. A hydraulic lash adjuster, as defined in claim 1, said annular shelf operable to establish a volume of fluid between said shelf and said valved opening which is dependent upon the angel of installation of said lash adjuster from vertical.

3. A hydraulic lash adjuster, as defined in claim 1, said radially inwardly extending annular shelf comprising a shaved inner layer of said inner wall of said axially extending passage.

* * * * *